US007347396B1

(12) United States Patent
Yu Chen

(10) Patent No.: US 7,347,396 B1
(45) Date of Patent: Mar. 25, 2008

(54) ADHESIVE-TAPE ROLL BASE FOR AN ADHESIVE-TAPE HOLDER

(76) Inventor: Hsiu-Man Yu Chen, No. 40, Sec. 1, Ta Fu Road, Tan Tzn Hsiang, Taichung (TW) 427

( * ) Notice: Subject to any disclaimer, the term of this patent is extended or adjusted under 35 U.S.C. 154(b) by 53 days.

(21) Appl. No.: 11/518,408

(22) Filed: Sep. 11, 2006

(51) Int. Cl.
*B65H 75/18* (2006.01)

(52) U.S. Cl. ..... 242/599.3; 242/588.6; 225/47

(58) Field of Classification Search ..... 242/598.5, 242/598.3, 591, 599.3, 588, 588.3, 588.6; D19/67–69, 75, 99, 100; 206/340, 341; 225/46, 225/47, 42, 45, 77, 35, 6
See application file for complete search history.

(56) References Cited

U.S. PATENT DOCUMENTS 4,059,210 A * 11/1977 Deering, Jr. ..... 225/47
5,228,612 A * 7/1993 Kuo et al. ..... 225/47
5,878,932 A * 3/1999 Huang ..... 225/65
6,311,923 B1 * 11/2001 Tsai ..... 242/598.5
6,371,403 B1 * 4/2002 Shen ..... 242/598.2
6,533,153 B2 * 3/2003 Huang ..... 225/47
6,651,857 B1 * 11/2003 Tsai ..... 225/42
6,688,549 B1 * 2/2004 Shen ..... 242/588

* cited by examiner

*Primary Examiner*—William A Rivera
(74) *Attorney, Agent, or Firm*—Ming Chow; Sinorica, LLC

(57) ABSTRACT

An adhesive-tape roll base for an adhesive-tape holder includes a base fixed thereon with an adhesive-tape holder having its upper side bored with an adhesive-tape accommodating cavity for receiving an adhesive-tape roll. The adhesive-tape accommodating cavity has one upper sidewall bored with a shaft hole having a position-limiting block formed on the bottom, and the other upper sidewall bored with a shaft groove. A positioning shaft has an axial guiding groove in one circumferential side and a position-limiting groove at an open end of the guiding groove. After inserted through the shaft hole and fixed on the adhesive-tape holder, the positioning shaft can be turned clockwise to make the position-limiting groove engaged with the position-limiting block, securing an adhesive-tape roll on the adhesive-tape holder.

2 Claims, 5 Drawing Sheets

ADHESIVE-TAPE ROLL BASE FOR AN ADHESIVE-TAPE HOLDER

BACKGROUND OF THE INVENTION

1. Field of the Invention

This invention relates to an adhesive-tape roll base for an adhesive-tape holder, particularly to one able to firmly assemble an adhesive tape roll on an adhesive-tape holder not to fall off even in case of applying force improperly.

2. Description of the Prior Art

A conventional adhesive-tape holder includes an upper shell and a lower shell combined together. The upper shell has its front end disposed with a saw blade for cutting off an adhesive tape and its intermediate portion formed with a cavity for receiving an adhesive-tape roll therein. Thus, when the adhesive tape on the adhesive-tape roll is drawn outward, the adhesive-tape roll will be rotated at the original position and the adhesive tape on the adhesive-tape roll can be continuously released for use.

However, when the adhesive tape on the adhesive-tape roll is drawn out, the adhesive-tape roll positioned in the cavity of the upper shell is likely to fall off the adhesive-tape holder in case of applying force improperly.

SUMMARY OF THE INVENTION

The objective of the invention is to offer an adhesive-tape roll base for an adhesive-tape holder, including a base having an adhesive-tape holder secured thereon. The adhesive-tape holder has the topside of its front wall plate assembled with an adhesive-tape saw blade, and its upper portion bored with an adhesive-tape accommodating cavity for receiving an adhesive-tape roll. The adhesive-tape accommodating cavity of the adhesive-tape holder has one upper side wall bored with a shaft hole having a position-limiting block formed on the bottom, and the other upper side wall bored with a shaft groove. A positioning shaft to be assembled on the adhesive-tape holder is bored with an axial through guiding groove in one circumferential side and a position-limiting groove at one side of an open end of the guiding groove in corresponding with the shaft hole. The position-limiting groove of the positioning shaft is exactly able to restrict and secure the position-limiting block therein, and has one open end corresponding with the shaft hole and the other end being closed. The positioning shaft of the adhesive-tape roll base enables an adhesive-tape roll to be conveniently assembled on the adhesive-tape holder. The positioning shaft is inserted through the shaft hole and fixed on the adhesive-tape holder, with the guiding groove moved along the position-limiting block of the shaft hole. After being positioned, the positioning shaft has one end secured in the shaft groove and the other end fitted in the shaft hole. Then, the positioning shaft can be turned clockwise to make the position-limiting groove engaged with the position-limiting block for securing the positioning shaft on the adhesive-tape holder, letting an adhesive-tape roll able to be firmly secured on the adhesive-tape holder and impossible to fall off even in case of applying force improperly.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
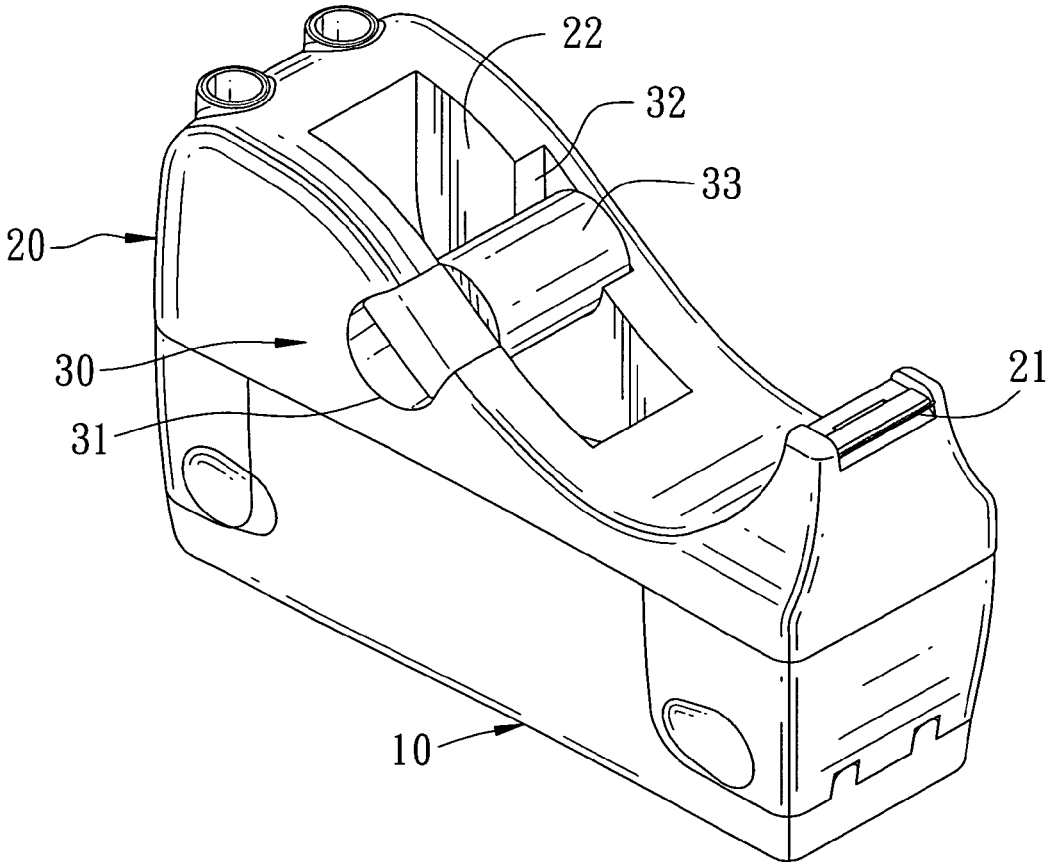
FIG. 1 is a perspective view of an adhesive-tape roll base for an adhesive-tape holder in the present invention.
Figure 2:
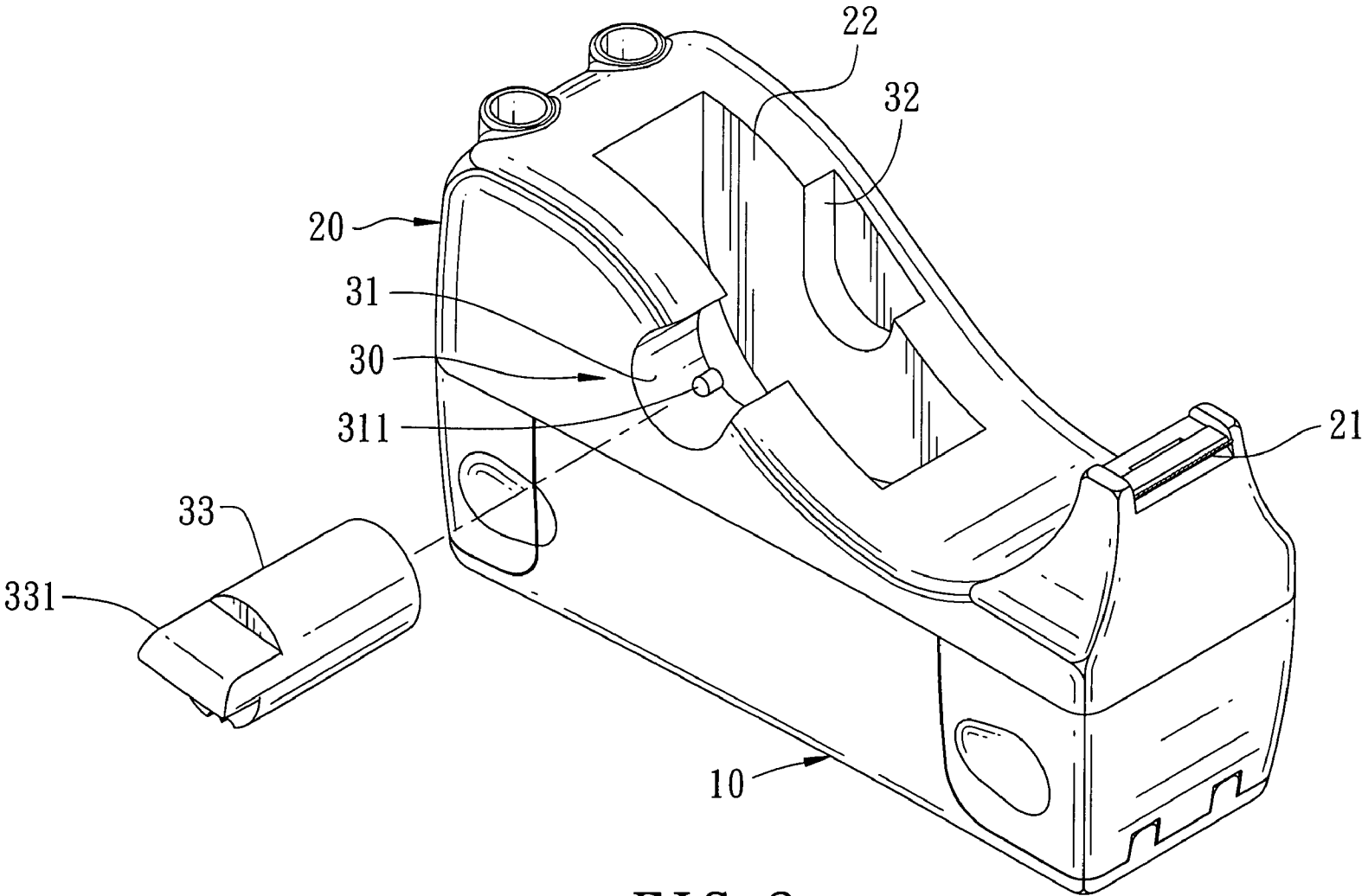
FIG. 2 is an exploded perspective view of the adhesive-tape roll base in the present invention.
Figure 3:
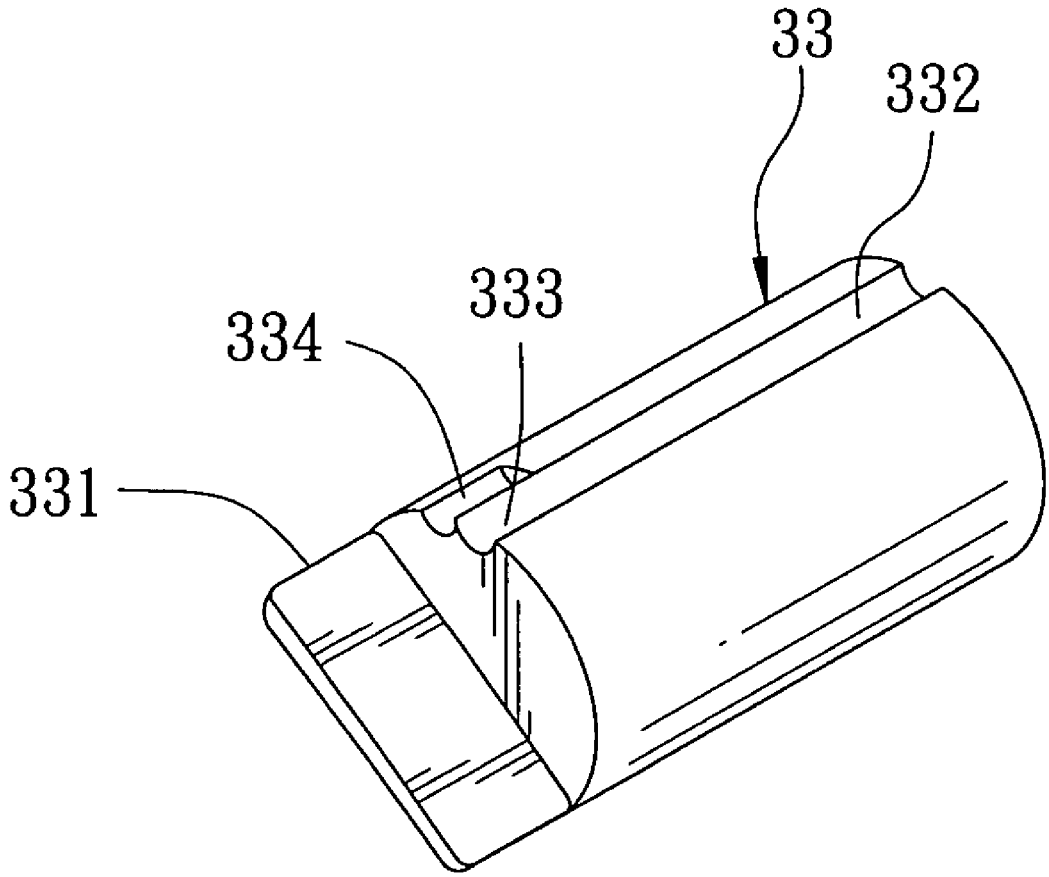
FIG. 3 is a perspective view of a positioning shaft in the present invention.

A preferred embodiment of an adhesive-tape roll base for an adhesive-tape holder in the present invention, as shown in FIGS. 1, 2 and 3, includes a base 10, an adhesive-tape holder 20 and an adhesive-tape roll base 30 as main components combined together.

The adhesive-tape holder 20 assembled on the base 10 has the topside of its front wall plate disposed with a saw blade 21 and its upper portion bored with an adhesive-tape accommodating cavity 22 at a preset location.

The adhesive-tape roll base 30 is positioned at a preset location of the adhesive-tape holder 20 at the upper side of the adhesive-tape accommodating cavity 22. The adhesive-tape accommodating groove 22 of the adhesive-tape holder 20 has one upper side wall bored with a shaft hole 31 being larger than a semicircle and having an open topside, and the shaft hole 31 has a position-limiting block 311 formed on a preset location of its bottom. The adhesive-tape accommodating groove 22 of the adhesive-tape holder 20 has the other upper sidewall bored with a shaft groove 32 with an arc-shaped bottom and an upward opening. The adhesive-tape roll base 30 also consists of a positioning shaft 33 whose length is approximately equivalent to the distance between the shaft hole 31 and the shaft groove 32. The positioning shaft 33 has a first end, opposite to the shaft groove 32, formed with a thin and flat holding member 331, and one circumferential side bored with an axial through guiding groove 332. The positioning shaft 33 is further bored with an axial position-limiting groove 334 at one side of the first end the guiding groove 332 with an open end abutting to the holding member 331 and a closed end. The position-limiting groove 334 is exactly able to restrict and secure the position-limiting block 311 therein. Thus, the positioning shaft 33 can be inserted through the shaft hole 31 and secured on the adhesive-tape holder 20 with the guiding groove 332 moved forward along the position-limiting block 311. After positioned, the positioning shaft 33 has one end secured in the shaft groove 32 and the other end fixed in the shaft hole 31. Afterward, the positioning shaft 33 can be turned clockwise by means of its holding portion 331 to make the position-limiting block 311 engaged in the position-limiting groove 334 to push against the closed end of the position-limiting groove 334. After the positioning shaft 33 is secured in position, the topside 335 of the holding member 31 of the positioning shaft 33 is flush with the upper edges of the opposite side walls of the adhesive-tape holder 20.

Figure 4:
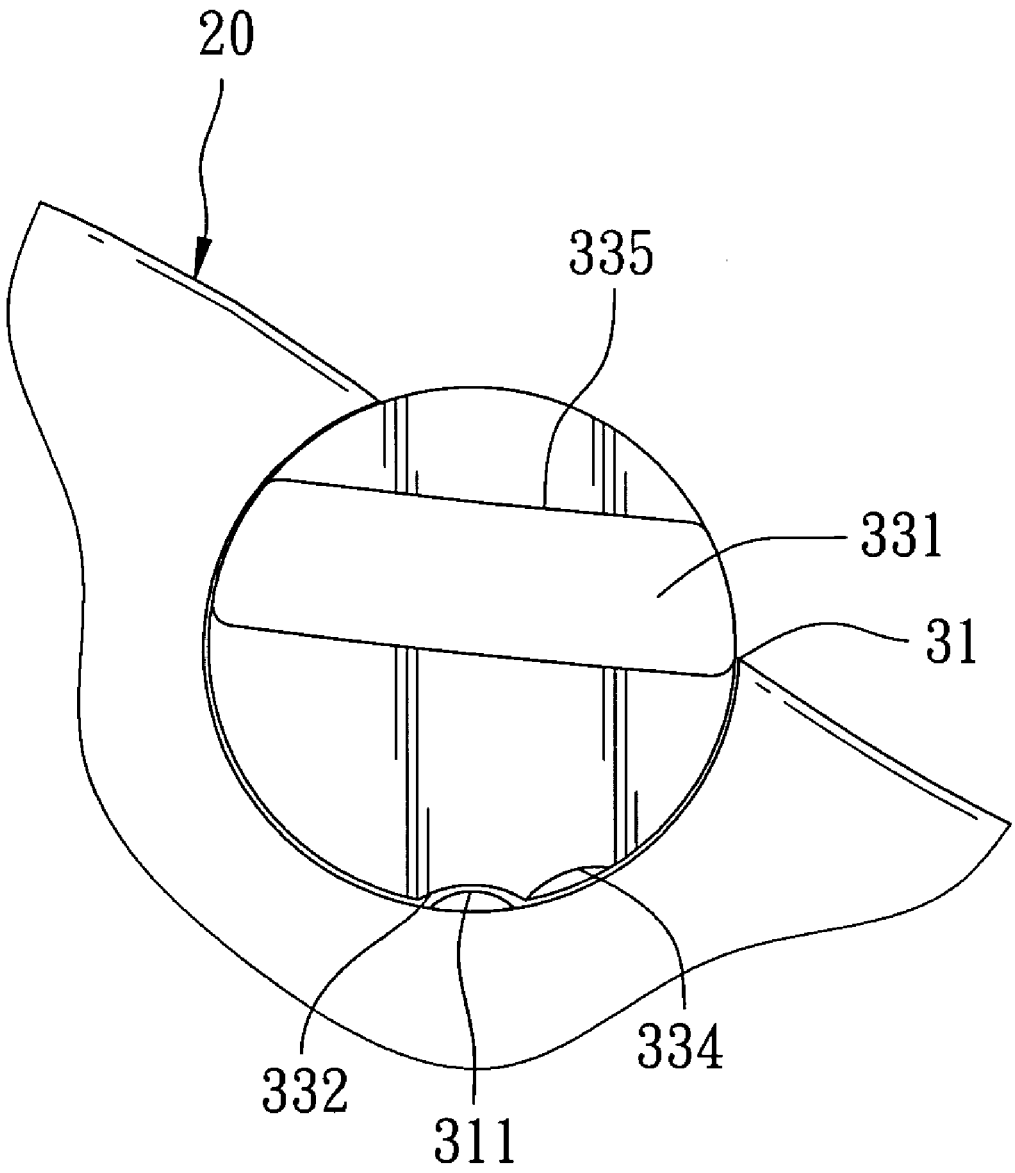
FIG. 4 is a side cross-sectional view of the adhesive-tape roll base being combined on an adhesive-tape holder in the present invention.
Figure 5:
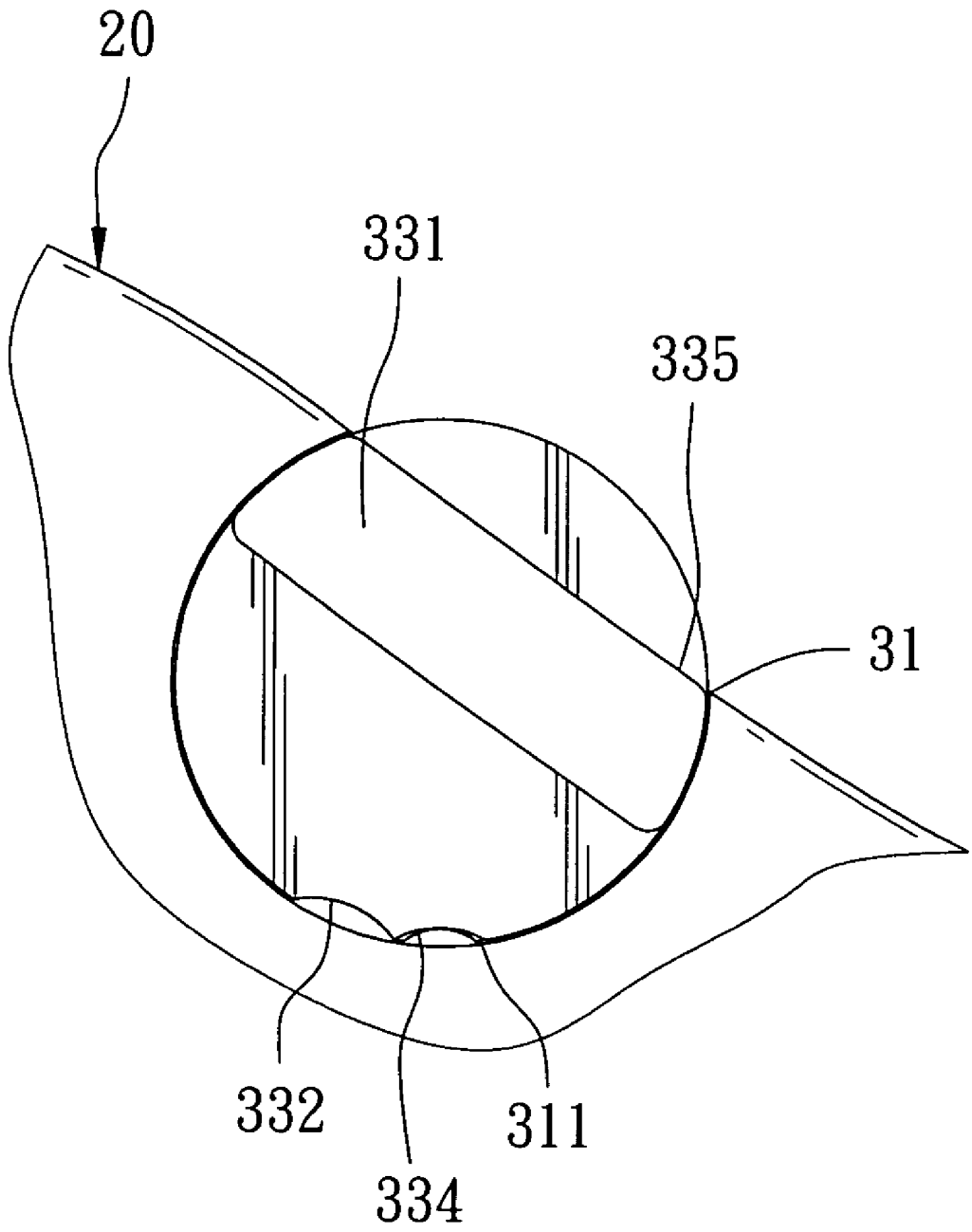
FIG. 5 is a side cross-sectional view of the adhesive-tape roll base secured on an adhesive-tape holder in the present invention.

In using, as shown in FIG. 4, firstly, place an adhesive-tape roll in the adhesive-tape accommodating cavity 22 of the adhesive-tape holder 20 and then hold the holding portion 331 of the positioning shaft 33 and insert the positioning shaft 33 through the shaft hole 31, with the guiding groove 332 of the positioning shaft 33 moved forward along the position-limiting block 311 letting one end of the positioning shaft 33 stabilize in the shaft hole 31 and the other end positioned in the shaft groove 32. When the positioning shaft 33 has the first end, opposite to the holding portion 331, secured in the shaft groove 32, the holding member 331 of the positioning shaft 33 is turned clockwise to let the position-limiting groove 334 at one side of the open end 333 of the guiding groove 332 engaged with the position-limiting block 311, as shown in FIG. 5. Thus, the positioning shaft 33 can firmly be secured on the adhesive-tape holder 20 by mutual engagement of the position-limiting block 331 and the position-limiting groove 334.

Specifically, the adhesive-tape roll base for an adhesive-tape holder in the present invention is provided with a positioning shaft to be inserted through the shaft hole and having its opposite ends respectively secured in the shaft groove and in the shaft hole. In addition, the positioning shaft can be firmly secured on the adhesive-tape holder by mutual engagement of the position-limiting groove at one end of the positioning shaft and the position-limiting block at the bottom of the shaft hole. By so designing, an adhesive-tape roll can be firmly positioned in the adhesive-tape accommodating cavity of the adhesive-tape holder not to fall off even in case of applying force improperly.

While the preferred embodiment of the invention has been described above, it will be recognized and understood that various modifications may be made therein and the appended claims are intended to cover all such modifications that may fall within the spirit and scope of the invention.

I claim:

1. An adhesive-tape roll base for an adhesive-tape holder comprising a base, said base assembled thereon with an adhesive-tape holder, said adhesive-tape holder having the upper side of its front wall plate disposed with an adhesive-tape saw blade, said adhesive-tape holder having its upper portion bored with an adhesive-tape accommodating cavity at a preset location, an adhesive-tape roll base installed at a preset location of said adhesive-tape holder at the upper side of said adhesive-tape accommodating cavity: and, Characterized by said adhesive-tape roll base bored with a shaft hole at one upper side wall of said adhesive-tape accommodating cavity, said shaft hole being larger than a semicircle and having an open topside, said shaft hole fixed with a position-limiting block at a preset location of its bottom, said adhesive-tape accommodating cavity of said adhesive-tape holder having the other upper side wall bored with a shaft groove with an arc-shaped bottom and an open topside, said adhesive-tape roll base provided with a positioning shaft, said positioning shaft having one circumferential side bored with an axial through guiding groove, said positioning shaft further bored with an axial position-limiting groove at one side of the open end of said guiding groove for matching with said position-limiting block of said shaft hole, said position-limiting groove having one end opened and corresponding to said shaft hole and the other end being closed, said position-limiting groove of said positioning shaft exactly able to restrictedly secure said position-limiting block therein, said positioning shaft able to be inserted through said shaft hole and fixed on said adhesive-tape holder with said guiding groove moved forward along said position-limiting block, said positioning shaft having one end secured in said shaft groove and the other end fitted in said shaft hole, said position-limiting groove able to be engaged with said position-limiting block for firmly securing said positioning shaft on said adhesive-tape holder by turning said positioning shaft clockwise.

2. The adhesive-tape roll base for an adhesive-tape holder as claimed in claim 1, wherein the length of said positioning shaft is approximately equivalent to the distance between said shaft hole and said shaft groove, and said positioning shaft is formed with a thin and flat holding member at one end opposite to said shaft groove, the topside of said holding member of said positioning shaft being flush with the opposite upper edges of said adhesive-tape holder after said positioning shaft is completely secured stably on said adhesive-tape holder.

* * * * *